US007129627B2

(12) United States Patent
Tagami

(10) Patent No.: US 7,129,627 B2
(45) Date of Patent: Oct. 31, 2006

(54) COLOR PICTURE TUBE APPARATUS

(75) Inventor: Etsuji Tagami, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 199 days.

(21) Appl. No.: 10/900,837

(22) Filed: Jul. 27, 2004

(65) Prior Publication Data

US 2005/0046328 A1 Mar. 3, 2005

(30) Foreign Application Priority Data

Aug. 29, 2003 (JP) ..... 2003-306466

(51) Int. Cl.
*H01J 29/70* (2006.01)

(52) U.S. Cl. ..... 313/440; 335/213; 335/297; 335/298

(58) Field of Classification Search ..... 313/440; 335/213, 297, 298
See application file for complete search history.

(56) References Cited

FOREIGN PATENT DOCUMENTS

| | | |
|---|---|---|
| EP | 0 981 149 | 2/2000 |
| EP | 1 162 643 | 12/2001 |
| JP | 61-56757 | 4/1986 |
| JP | 7-35289 | 8/1995 |
| JP | 2002-260554 | 9/2002 |

*Primary Examiner*—Joseph Williams
*Assistant Examiner*—Bumsuk Won
(74) *Attorney, Agent, or Firm*—Hamre, Schumann, Mueller & Larson, P.C.

(57) ABSTRACT

A ferrite core constituting a deflection yoke includes a plurality of convex portions in a ridge shape on an inner surface thereof. Among the plurality of convex portions, assuming that the convex portions in a range excluding a range of −20° to +20° with respect to a horizontal axis and a range of −20° to +20° with respect to a vertical axis are diagonal convex portions, the lengths in a tube axis direction of at least horizontal axial convex portions on a horizontal axis or vertical axial convex portions on a vertical axis are larger than those of the diagonal convex portions. Because of this, a color picture tube apparatus with a deflection power reduced can be provided while the degree of freedom in a winding arrangement of deflection coils is secured.

16 Claims, 8 Drawing Sheets

COLOR PICTURE TUBE APPARATUS

BACKGROUND OF THE INVENTION

1. Field of the Invention

The present invention relates to a color picture tube apparatus used in a television, a computer display, or the like.

2. Description of the Related Art

In order to reduce a deflection power and suppress the heat generated by a deflection yoke, JP61(1986)-56757U discloses a so-called slot core in which a plurality of convex portions protruding toward a tube axis of a picture tube are provided on an inner surface of a ferrite core constituting a deflection yoke. FIG. 7 shows a cross-sectional view of the deflection yoke with the slot core, taken along a surface vertical to the tube axis at a position close to an electron gun. Reference numeral 9 denotes a ferrite core, and 10 denotes a plurality of convex portions provided on an inner surface of the ferrite core 9. Windings are inserted in grooves between the convex portions 10 adjacent to each other in a circumferential direction, whereby a vertical deflection coil 7 and a horizontal deflection coil 6 are wound therein. Reference numeral 8 denotes an insulating spacer for insulating the vertical deflection coil 7 from the horizontal deflection coil 6. Each convex portion 10 extends over the entire region in a tube axis direction from an end on an electron gun side of the ferrite core 9 to an end on a screen side thereof, along a surface including the tube axis. By providing such convex portions 10, compared with the case where the convex portions 10 are not provided, the ferrite core 9 can be brought close to the picture tube. Therefore, the deflection efficiency can be enhanced, which is advantageous for reducing a deflection power. Furthermore, since a magnetic flux is unlikely to cross the coils 6, 7, an eddy current loss-is reduced, and the heat generated by the deflection yoke also can be decreased.

In the slot core of JP61(1986)-56757U, windings of the horizontal deflection coil 6 and the vertical deflection coil 7 are inserted to be wound in the grooves between the plurality of convex portions 10 extending between both ends in the tube axis direction of the ferrite core 9. Therefore, it is necessary to arrange the winding of the horizontal deflection coil 6 and the winding of the vertical deflection coil 7 along the common grooves so as not to allow them to extend off the grooves over the entire length in the tube axis direction of the ferrite core 9. Thus, there is a limit to the degree of freedom in a winding arrangement.

In order to solve the above-mentioned problem, JP7(1995)-35289Y proposes a ferrite core 9 in which convex portions 10 are provided only in a partial region on an electron gun side in a tube axis direction. FIG. 8 shows a front view of the ferrite core 9 seen from a screen side. In the ferrite core 9 shown in FIG. 8, the convex portions 10 are not formed on an inner surface on the screen side. Thus, by freely setting the winding arrangement of a horizontal deflection coil and a vertical deflection coil in a region where the convex portions 10 are not formed, a deflection magnetic field distribution can be adjusted appropriately, so that a color shift and raster distortion can be reduced.

However, the slot core shown in FIG. 8 cannot sufficiently satisfy the recent request for further reducing a deflection power.

SUMMARY OF THE INVENTION

The present invention has been achieved in order to solve the above-mentioned problem in the prior art, and its object is to provide an energy-efficient color picture tube apparatus of very excellent quality, including a deflection yoke capable of further reducing a deflection power while maintaining the degree of freedom in a winding arrangement of coils.

In order to achieve the above-mentioned object, a color picture tube apparatus according to the present invention includes a deflection yoke for allowing a horizontal deflection magnetic field and a vertical deflection magnetic field to act on electron beams emitted from an electron gun to deflect the electron beams in a horizontal direction and a vertical direction. The deflection yoke includes a ferrite core, a horizontal deflection coil for generating the horizontal deflection magnetic field, a vertical deflection coil for generating the vertical deflection magnetic field, and an insulating frame for insulating the horizontal deflection coil from the vertical deflection coil. The ferrite core includes a plurality of convex portions arranged on an inner surface thereof in a circumferential direction of the ferrite core, and the respective convex portions protrude toward a tube axis of the color picture tube apparatus, and have a ridge shape substantially along a surface including the tube axis. Among the plurality of convex portions, it is assumed that the convex portions on a horizontal axis are horizontal axial convex portions, the convex portions on a vertical axis are vertical axial convex portions, and the convex portions in a range excluding a range of −20° to +20° with respect to the horizontal axis and a range of −20° to +20° with respect to the vertical axis are diagonal convex portions.

In the first color picture tube apparatus of the present invention, lengths in a tube axis direction of the vertical axial convex portions are larger than those of the diagonal convex portions.

In the second color picture tube apparatus of the present invention, lengths in the tube axis direction of the horizontal axial convex portions are larger than those of the diagonal convex portions.

In the third color picture tube apparatus of the present invention, lengths in the tube axis direction of the horizontal axial convex portions and the vertical axial convex portions are larger than those of the diagonal convex portions.

These and other advantages of the present invention will become apparent to those skilled in the art upon reading and understanding the following detailed description with reference to the accompanying figures.

DESCRIPTION OF THE PREFERRED EMBODIMENTS

In the color picture tube of the present invention, the lengths in the tube axis direction of at least the horizontal axial convex portions or the vertical axial convex portions are larger than those of the diagonal convex portions. Therefore, a deflection power can be reduced while the degree of freedom in a winding arrangement of the horizontal deflection coil and the vertical deflection coil is secured. Thus, the windings of the horizontal deflection coil and the vertical deflection coil can be arranged so as to provide a desired deflection magnetic field distribution, so that an energy-efficient color picture tube of very excellent quality can be provided.

Hereinafter, the present invention will be described by way of specific numerical examples. However, the following numerical examples are shown merely for illustrative purposes, and the present invention is not limited thereto.

Figure 1:
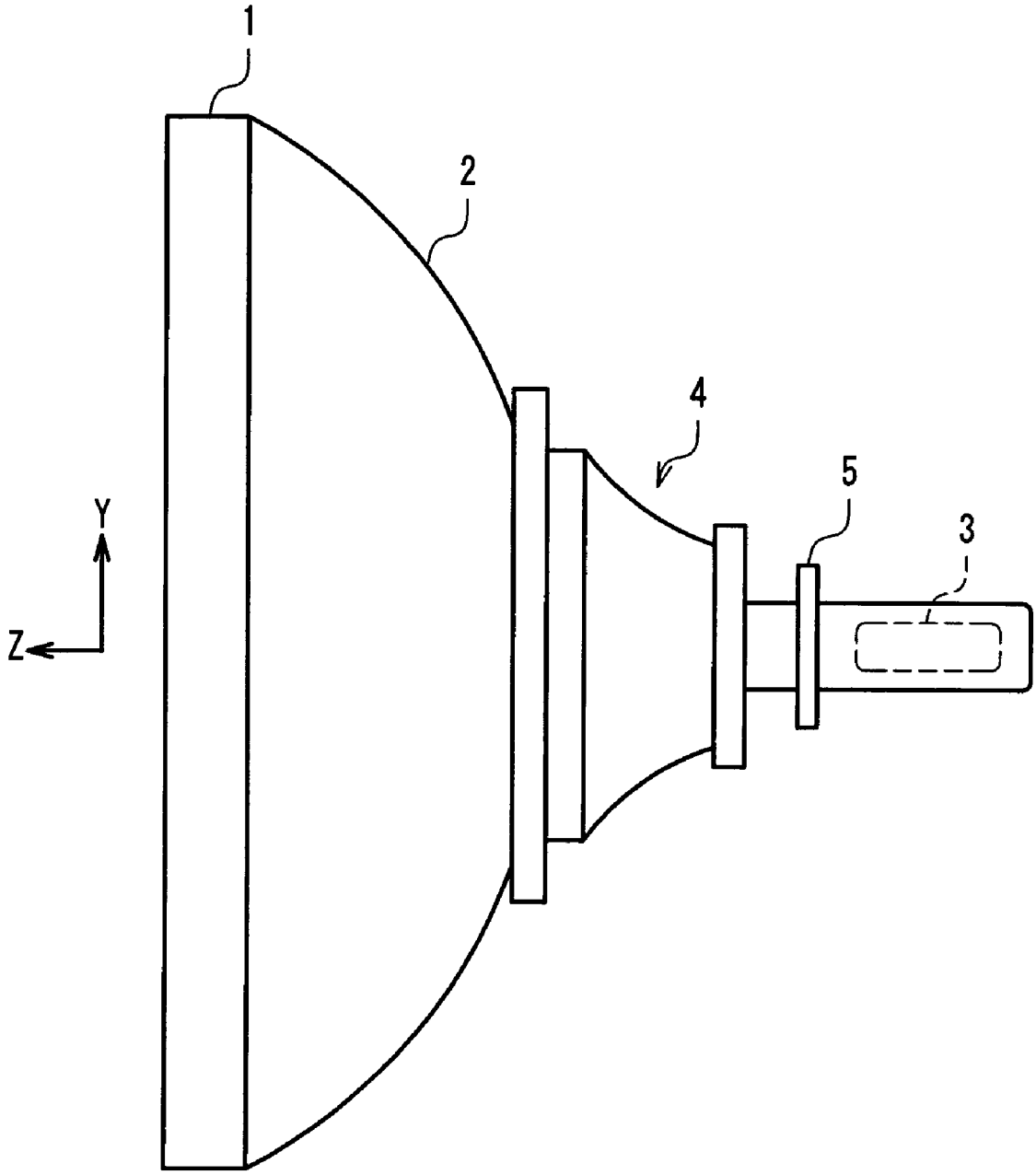
FIG. 1 is a side view showing an outer appearance of a color picture tube apparatus according to one embodiment of the present invention.

FIG. 1 is a view showing an outer appearance of a color picture tube apparatus to which the present invention is applied, having a flat screen with a diagonal size of 36 inches and an aspect ratio of 16:9,and a deflection angle of 100°. For convenience of the following description, it is assumed that a tube axis is a Z-axis, an axis in a horizontal direction gong side direction of a screen) is an X-axis, and an axis in a vertical direction (short side direction of a screen) is a Y-axis. The X-axis and the Y-axis cross each other on the Z-axis at right angles.

The color picture tube apparatus includes: a color picture tube, which has an envelope composed of a front panel 1 with a phosphor screen (not shown) formed on an inner surface thereof and a funnel 2, and an electron gun 3 provided in a neck portion of the funnel 2; and a deflection yoke 4 and a convergence yoke 5 that are mounted on an outer circumferential surface of the funnel 2. The electron gun 3 includes three cathodes arranged in an in-line shape in the X-axis direction, and emits three electron beams corresponding to three colors of red (R), green (G), and blue (B).

Figure 2:
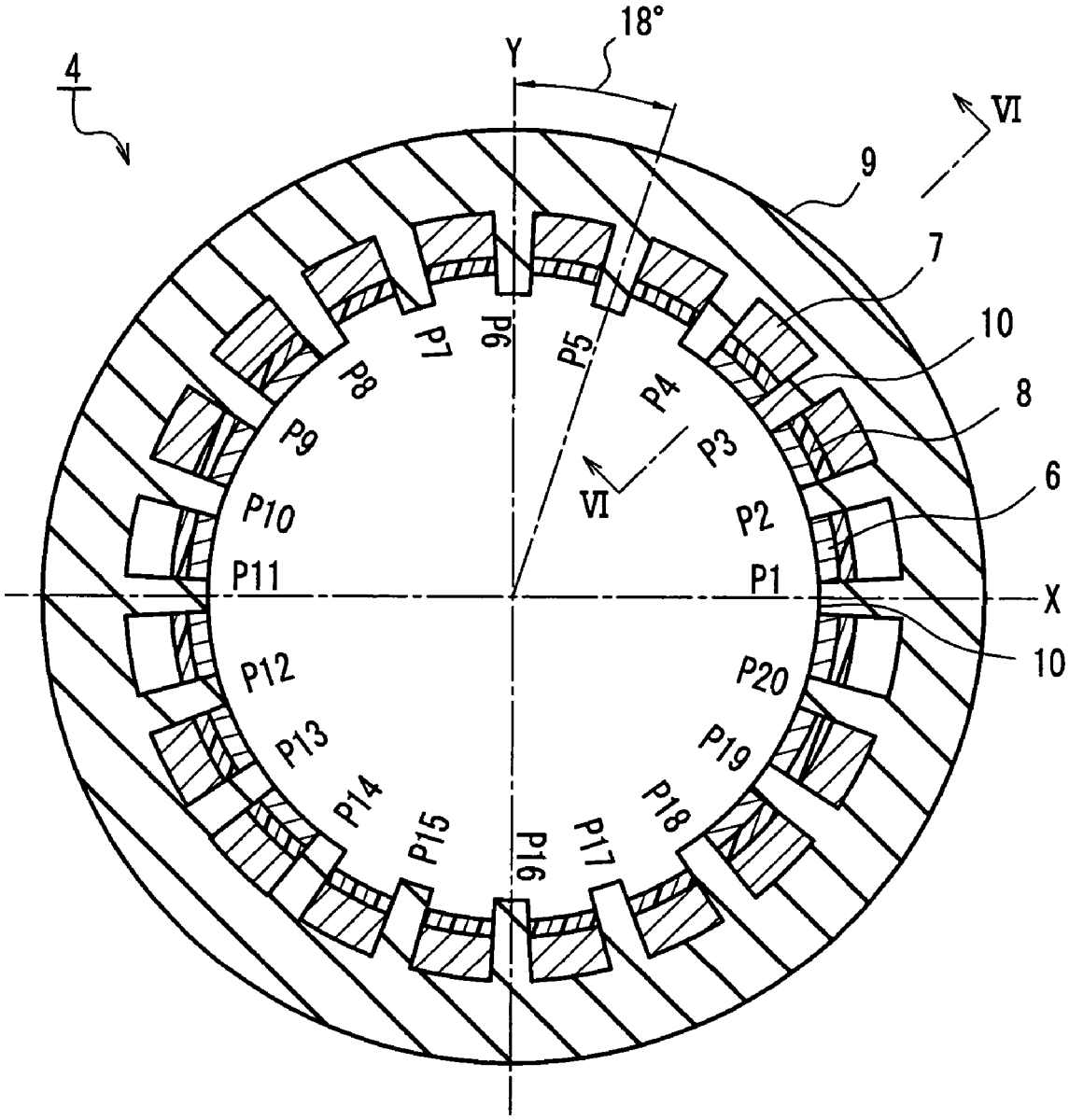
FIG. 2 is a cross-sectional view of a deflection yoke according to one embodiment of the present invention, taken along a surface vertical to a Z-axis.

FIG. 2 is a cross-sectional view of the deflection yoke 4, taken along a surface vertical to the Z-axis at a position including a ferrite core 9. The deflection yoke 4 includes the ferrite core 9, a saddle-type horizontal deflection coil 6 generating a horizontal deflection magnetic field for deflecting the electron beams in a horizontal direction and a vertical deflection coil 7 generating a vertical deflection magnetic field for deflecting the electron beams in a vertical direction, and an insulating spacer 8 made of resin for insulating the horizontal deflection coil 6 from the vertical deflection coil 7.

The ferrite core 9 has a substantially funnel shape, and a plurality of convex portions 10 protruding toward the Z-axis and having a ridge shape substantially along a surface including the Z-axis are formed on an inner surface of the ferrite core 9. In the present embodiment, the number of the convex portions 10 is twenty, and the convex portions 10 are placed in a circumferential direction of the inner surface of the ferrite core 9 at an equal angular interval of 18° with respect to the Z-axis. Herein, as shown in FIG. 2, the convex portion 10 on the right side on the X-axis is referred to as a convex portion P1, and twenty convex portions 10 are assigned serial numbers successively from the convex portion P1 in a counterclockwise direction, whereby the twenty convex portions 10 are discriminated by referring to them as convex portions P1 to P20. Then, the convex portions P1, P11 on the X-axis are referred to as horizontal axial convex portions and the convex portions P6, P16 on the Y-axis are referred to as vertical axial convex portions.

Each winding of the horizontal deflection coil 6 and/or the vertical deflection coil 7 is inserted to be fixed in grooves between the convex portions 10 adjacent to each other in a circumferential direction. The insulating spacer 8 is interposed between the horizontal deflection coil 6 and the vertical deflection coil 7, to provide the insulation therebetween.

Figure 3:
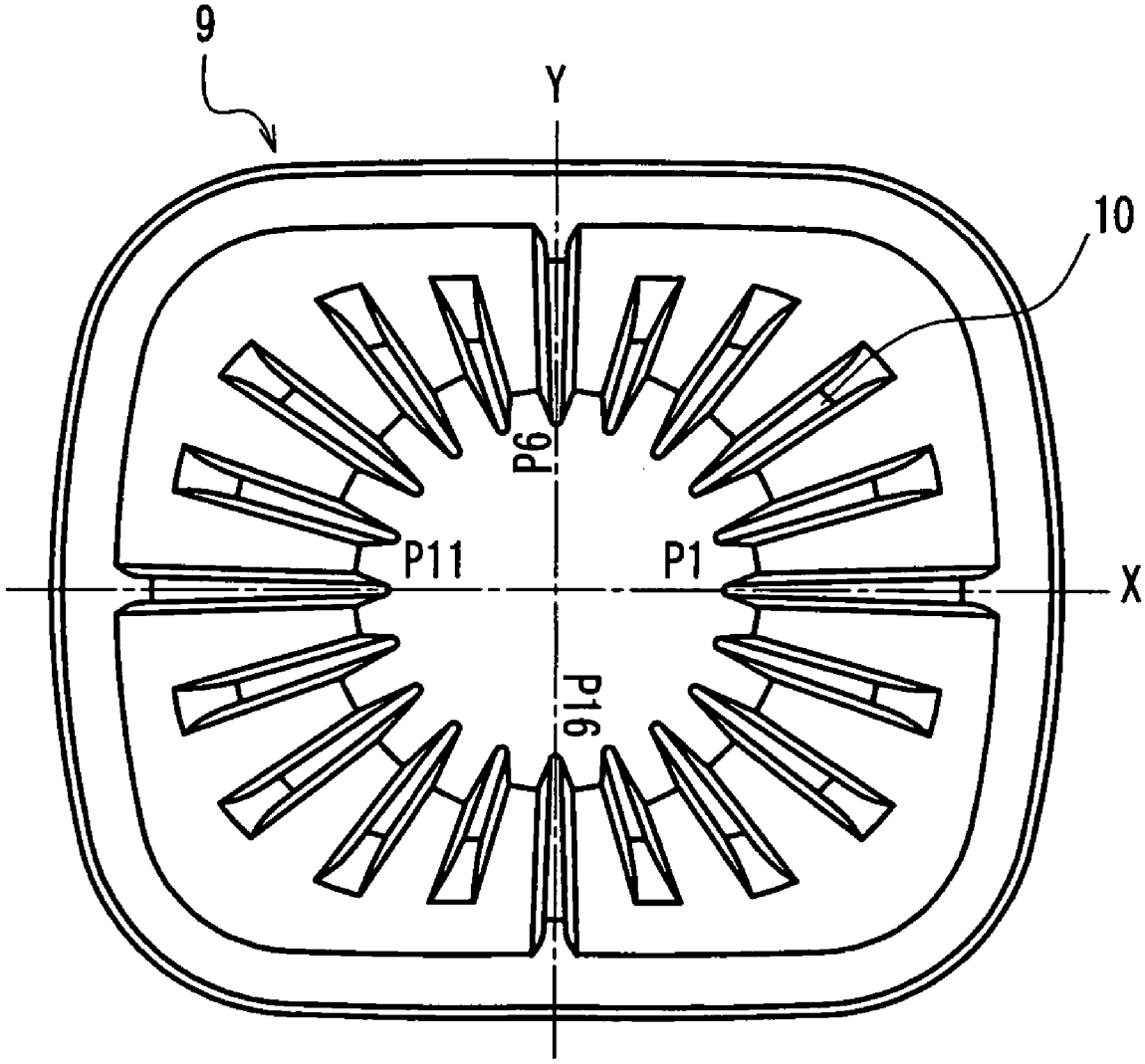
FIG. 3 is a front view of a ferrite core according to one embodiment of the present invention, seen from a screen side (large diameter side).

FIG. 3 is a front view of the ferrite core 9, seen from a screen side (large diameter side). As shown in FIG. 3, the lengths in the Z-axis direction of the convex portions P1 to P20 are not necessarily the same. Specifically, for the size of 45 mm in the Z-axis direction of the ferrite core 9, the lengths in the Z-axis direction of the horizontal axial convex portions P1, P11 and the vertical axial convex portions P6, P16, which particularly influence deflection sensitivity, are 45 mm, and those of the other convex portions P2 to P5, P7 to P10, P12 to P15, and P17 to P20 are 30 mm. Herein, the end positions of all the convex portions P1 to P20 on an electron gun side (small diameter side) in the Z-axis direction may be matched with the end position of the ferrite core 9 on the electron gun side in the Z-axis direction.

It is assumed that the ratio of the lengths in the Z-axis direction of the convex portions 10 with respect to the size in the Z-axis direction of the ferrite core 9 is RL. For the horizontal axial convex portions P1, P11 and the vertical axial convex portions P6, P16, RL=1,and for the other convex portions P2 to P5, P7 to P10, P12 to P15, and P17 to P20, RL=0.67.

In general, as the lengths in the Z-axis direction of the convex portions 10 are larger (i.e., as the ratio RL is increased), a deflection power is reduced more effectively, while the degree of freedom in a winding arrangement of coils is decreased. However, according to the study by the inventors of the present invention, when the RL exceeds a certain value, the effect of reducing a deflection power is saturated substantially. Thus, the present embodiment is designed as a result of confirming that an optimum balance point between the reduction in a deflection power and the securing of the degree of freedom in a winding arrangement of coils is obtained at RL=0.67.In accordance with this, the RL of the convex portions P2 to P5, P7 to P10, P12 to P15, and P17 to P20 is set so as to be matched with the optimum balance point. However, the RL of the horizontal axial convex portions P1, P11 and the vertical axial convex portions P6, P16 intentionally is set to be a value (RL=1) outside of the optimum balance point. Thus, it was confirmed by an experiment that a deflection power can be reduced by 2 to 3% compared with the case where the RL of all the convex portions P1 to P20 is set to be 0.67.Furthermore, in this case, the degree of freedom in a winding arrangement of coils is not impaired. This will be described hereinafter.

Figure 4:
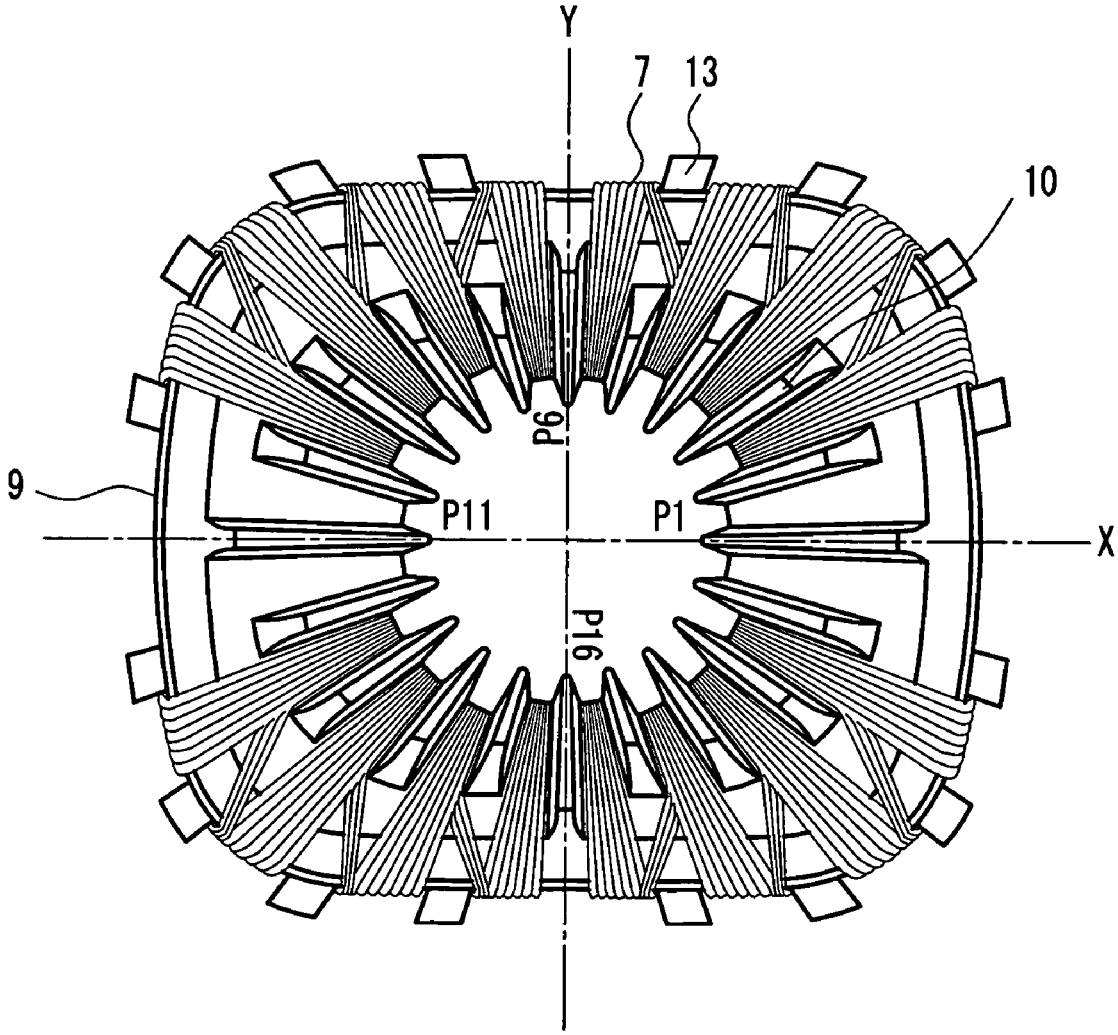
FIG. 4 is a front view of a ferrite core with a vertical deflection coil wound thereon according to one embodiment of the present invention, seen from the screen side.

First, the vertical deflection coil 7 will be described. FIG. 4 is a front view of the ferrite core 9 with the vertical deflection coil 7 wound thereon, seen from the screen side. In FIG. 4, reference numeral 13 denotes protrusions for guidance of winding of the vertical deflection coil, provided at substantially the same angular positions as those of the convex portions 10 with respect to the Z-axis, on an outer circumferential edge on the large diameter side of the ferrite core 9.

The vertical deflection coil 7 is composed of a pair of windings wound symmetrically with respect to a YZ-plane. In a range where the convex portions P2 to P5, P7 to P10, P12 to P15, and P17 to P20 are provided in the Z-axis direction on an inner surface of the ferrite core 9, the windings are inserted to be fixed in grooves between the adjacent convex portions 10, and in a range where the convex portions P2 to P5, P7 to P10, P12 to P15, and P17 to P20 are not provided, the windings are arranged so as to provide a desired winding distribution. On the large diameter side of the ferrite core 9, the windings are guided to be fixed between the protrusions 13. Thus, the winding allocation to the grooves between the adjacent convex portions 10 on the small diameter side and the winding allocation between the protrusions 13 on the large diameter side can be set freely and independently from each other, so that the degree of freedom in a winding arrangement can be secured.

In this case, the horizontal axial convex portions P1, P11 and the vertical axial convex portions P6, P16, extending to the end on the large diameter side of the ferrite core 9, do not impair the degree of freedom in a winding arrangement. The reasons for this are as follows: the vertical deflection coil 7 needs to form a magnetic field substantially in the X-axis direction inside the ferrite core 9, so that the windings thereof are not arranged in the vicinity of the horizontal axial convex portions P1, P 11, and the vertical deflection coil 7 is composed of a pair of windings sandwiching the YZ-plane, so that windings are not placed so as to cross the YZ-plane.

Figure 5:
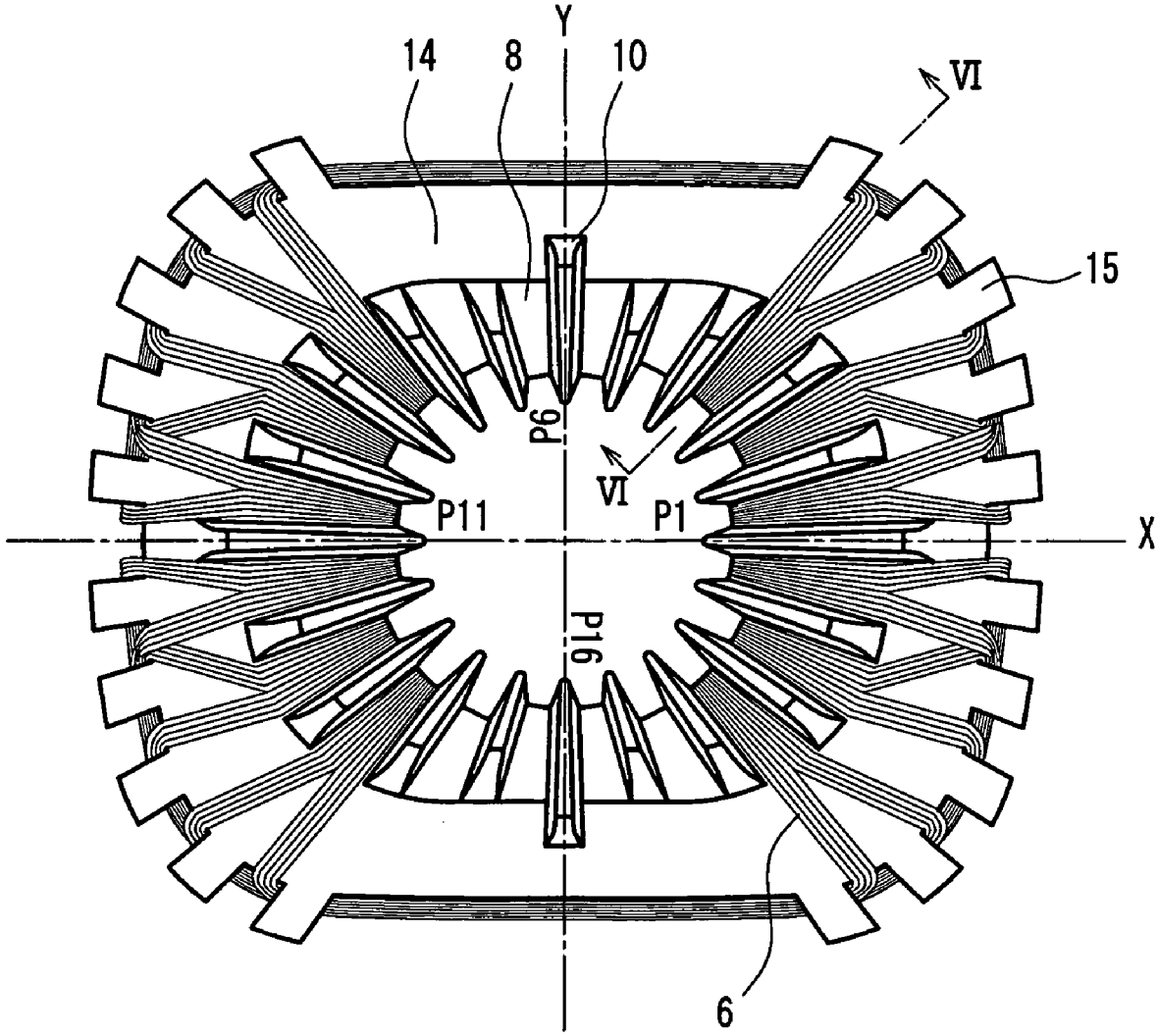
FIG. 5 is a front view of a ferrite core with a horizontal deflection coil wound thereon according to one embodiment of the present invention, seen from the screen side.
Figure 6:
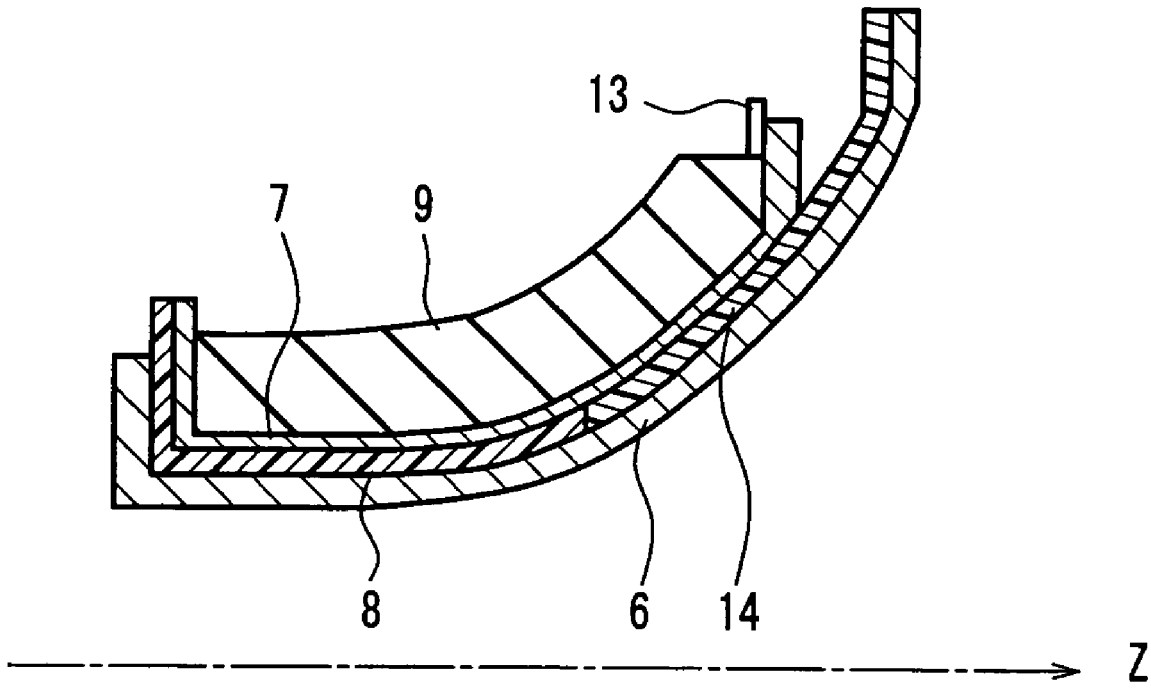
FIG. 6 is a cross-sectional view taken along a line VI-VI in FIGS. 2 and 5, seen in an arrow direction.
Figure 7:
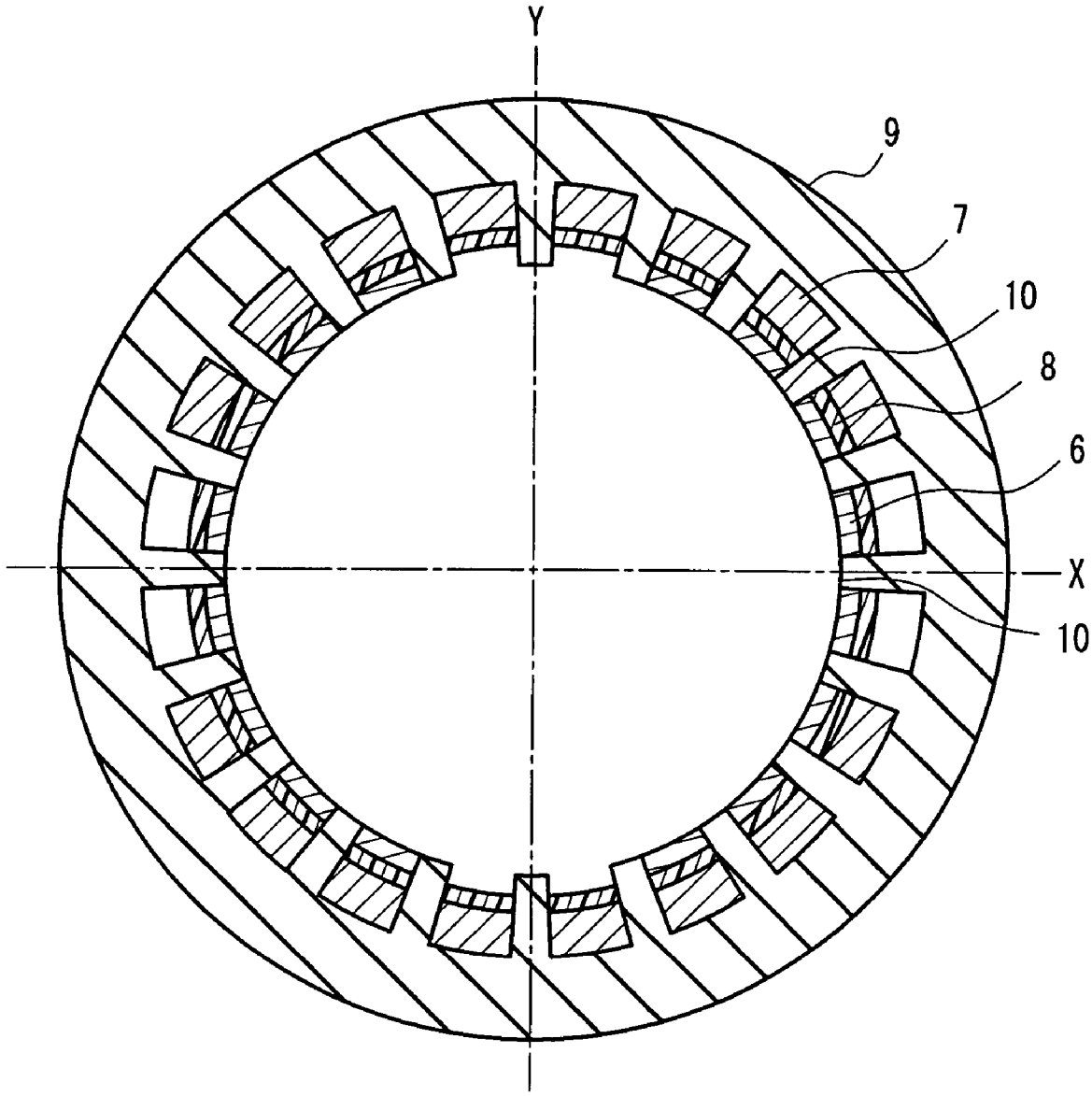
FIG. 7 PRIOR ART
FIG. 7 is a cross-sectional view of a conventional deflection yoke, taken along a surface vertical to a tube axis.
Figure 8:
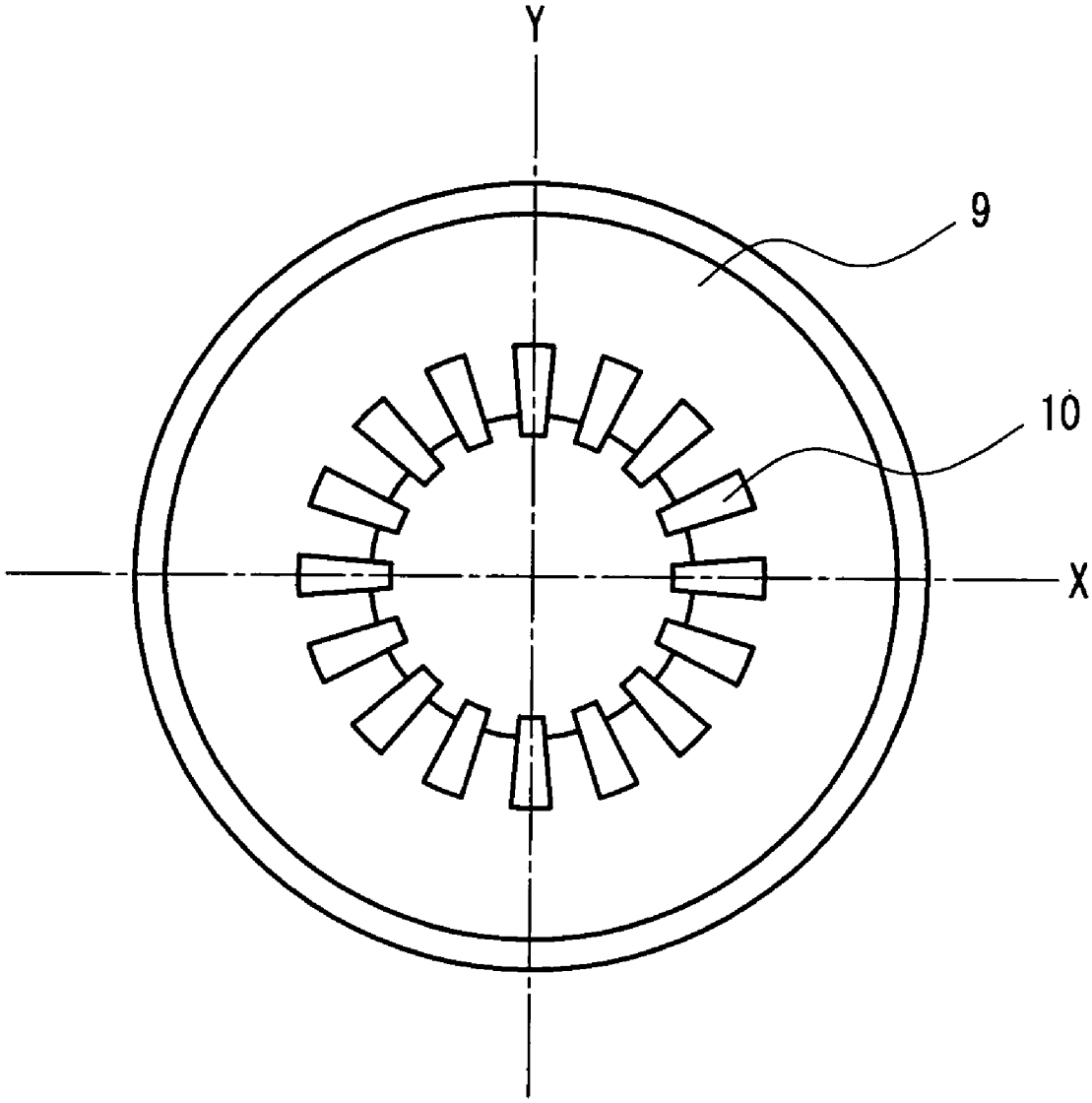
FIG. 8 PRIOR ART
FIG. 8 is a front view of a conventional ferrite core, seen from the screen side.

Next, the horizontal deflection coil 6 will be described. FIG. 5 is a front view of the ferrite core 9 (not shown in FIG. 5) with the horizontal deflection coil 6 wound thereon, seen from the screen side. FIG. 6 is cross-sectional view taken along a line VI—VI in FIGS. 2 and 5, seen in an arrow direction. The horizontal deflection coil 6 is placed further toward the Z-axis side than the vertical deflection coil 7. Furthermore, it is necessary to maintain insulation between the horizontal deflection coil 6 and the vertical deflection coil 7. As shown in FIG. 6, on an inner side of the vertical deflection coil 7, in a range where the convex portions P2 to P5, P7 to P10, P12 to P15, and P17 to P20 are provided in the Z-axis direction, the insulating spacer 8 is provided, and in a range where the convex portions P2 to P5, P7 to P10, P12 to P15, and P17 to P20 are not provided, a funnel-shaped insulating ring 14 made of resin is provided. The insulating spacer 8 and the insulating ring 14 both function as an insulating frame for insulating the horizontal deflection coil 6 from the vertical deflection coil 7. In the insulating spacer 8, slits (cut-away portions) are provided at positions corresponding to the convex portions 10 on an inner surface of the ferrite core 9. Therefore, as shown in FIG. 2, the insulating spacer 8 is inserted in the grooves between the convex portions 10, and the convex portions 10 protrude further toward the Z-axis than the insulating spacer 8. In FIG. 5, reference numeral 15 denotes protrusions for guidance of winding of the horizontal deflection coil, provided at substantially the same angular positions as those of the convex portions 10 with respect to the Z-axis, on an outer circumferential edge on the large diameter side of the insulating ring 14.

The horizontal deflection coil 6 is composed of a pair of windings wound so as to be symmetrical with respect to an XZ-plane. In the range where the convex portions P2 to P5, P7 to P10, P12 to P15, and P17 to P20 are provided in the Z-axis direction, the windings are inserted in the grooves between the adjacent convex portions 10 to be fixed on an inner surface of the insulating spacer 8, and in the range where the convex portions P2 to P5, P7 to P10, P12 to P15, and P17 to P20 are not provided, the windings are placed along an inner surface of the insulating ring 14 so as to provide a desired winding distribution. On the large diameter side of the insulating ring 14, the windings are guided to be fixed between the protrusions 15. Thus, a winding allocation to the grooves between the adjacent convex portions 10 on the small diameter side and the winding allocation between the protrusions 15 on the large diameter side can be set freely and independently from each other, so that the degree of freedom in a winding arrangement can be secured.

In this case, the horizontal axial convex portions P1, P11 and the vertical axial convex portions P6, P16, extending to the end on the large diameter side of the ferrite core 9, do not impair the degree of freedom in a winding arrangement. The reasons for this are as follows: the horizontal deflection coil 6 is composed of a pair of windings sandwiching the XZ-plane, so that the windings are not placed so as to cross the XZ-plane, and the horizontal deflection coil 6 needs to form a magnetic field inside the ferrite core 9 substantially in the Y-axis direction, so that the windings thereof are not placed in the vicinity of the vertical axial convex portions P6, P16.

As described above, according to the above-mentioned embodiment, among the plurality of convex portions 10 provided on an inner surface of the ferrite core 9, the lengths in the Z-axis direction of the horizontal axial convex portions P1, P11 and the vertical axial convex portions P6, P16 are set to be larger than those of the other convex portions P2 to P5, P7 to P10, P12 to P15, and P17 to P20. Therefore, a deflection power can be reduced by 2 to 3%, while the degree of freedom in a winding arrangement of the horizontal deflection coil 6 and the vertical deflection coil 7 is secured.

The present invention is not limited to the above-mentioned embodiment, and can be modified variously.

For example, in the above-mentioned embodiment, the lengths in the Z-axis direction of the horizontal axial convex portions P1, P11 and the vertical axial convex portions P6, P16 are set to be larger than those of the other convex portions. However, the horizontal axial convex portions P1, P11 or the vertical axial convex portions P6, P16 may be set to be larger than those of the other convex portions. In this case, although the effect of reducing a deflection power is degraded slightly compared with the above-mentioned embodiment, the degree of freedom in a winding arrangement can be secured similarly.

Furthermore, in the above-mentioned embodiment, the convex portions, the lengths of which in the Z-axis direction are set to be larger, are limited to the horizontal axial convex portions P1, P11 and the vertical axial convex portions P6, P16. However, the lengths in the Z-axis direction of the convex portions placed in the vicinity of the X-axis and the Y-axis (although not positioned on the X-axis and the Y-axis) may be set to be larger similarly. Assuming that the convex portions (corresponding to the convex portions P1, P2, P10 to P12, and P20 in the above embodiment) in a range of −20° to +20° from the X-axis with respect to the Z-axis are referred to as the convex portions in the vicinity of the horizontal axis, the convex portions (corresponding to the convex portions P5 to P7, and P15 to P17 in the above embodiment) in a range of −20° to +20° from the Y-axis with respect to the Z-axis are referred to as the convex portions in the vicinity of the vertical axis, and the convex portions (corresponding to the convex portions P3, P4, P8, P9, P13, P14, P18, and P19 in the above embodiment) in a range excluding the range of −20° to +20° from the X-axis with respect to the Z-axis and the range of −20° to +20° from the Y-axis with respect to the Z-axis are referred to as diagonal convex portions, the lengths in the Z-axis direction of the convex portions in the vicinity the horizontal axis or the convex portions in the vicinity of the vertical axis (preferably, both of the convex portions) may be set to be larger than those of the diagonal convex portions. As the ratio in number of the convex portions 10 whose lengths in the Z-axis direction are larger is increased, the effect of reducing a deflection power is enhanced. It was confirmed by an experiment that, in the above embodiment, when all the lengths in the Z-axis direction of the convex portions in the vicinity of the horizontal axis P1, P2, P10 to P12, and P20 and the convex portions in the vicinity of the vertical axis P5 to P7 and P15 to P17 are set to be 45 mm (RL=1), the deflection power can be reduced by 3%, compared with the case where the RL of all the convex portions P1 to P20 is set to be 0.67.Furthermore, in this case, the degree of freedom in a winding arrangement of the coils were not impaired. The angle of the convex portions 10 with respect to the X-axis or the Y-axis is defined as an angle of a center line of the convex portion 10, passing through the Z-axis on an XY-plane shown in FIG. 2, with respect to the X-axis or the Y-axis.

In the above-mentioned embodiment, the ratio RL regarding the diagonal convex portions was set to be 0.67.However, the present invention -is not limited thereto. In particular, when the ratio RL regarding the diagonal convex portions is set to be 0.67 or more in a range that does not remarkably decrease the degree of freedom in a winding arrangement of the coils, the deflection power can be reduced.

According to the present invention, in the case where the lengths in the Z-axis direction of the convex portions 10 are varied, it is preferable that the end positions of the long and short convex portions on the electron gun side in the Z-axis direction are set to be the same position in the vicinity of the end position of the ferrite core 9 on the electron gun side (small diameter side) in the Z-axis direction, and the ends on the phosphor screen side of the long convex portions are positioned further on the phosphor screen side with respect to the ends on the phosphor screen side of the short convex portions. Because of this, the winding arrangement of the coils can be adjusted on the large diameter side of the ferrite core 9, so that a larger adjustment range can be provided compared with the case of adjusting the winding arrangement on the small diameter side. Thus, a desired deflection magnetic field distribution can be provided easily.

The case has been described where the cross-sectional shape of the ferrite core 9 on a surface vertical to the Z-axis shown in the above-mentioned embodiment is substantially circular on the small diameter side and substantially rectangular on the large diameter side. However, the present invention is not limited thereto. For example, irrespective of the position in the Z-axis direction, the cross-sectional shape on a surface vertical to the Z-axis may be substantially circular.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture rube apparatus comprising a deflection yoke for allowing a horizontal deflection magnetic field and a vertical deflection magnetic field to act on electron beams emitted from an electron gun to deflect the electron beams in a horizontal direction and a vertical direction, wherein the deflection yoke includes a ferrite core, a horizontal deflection coil for generating the horizontal deflection magnetic field, a vertical deflection coil for generating the vertical deflection magnetic field, and an insulating frame for insulating the horizontal deflection coil from the vertical deflection coil, the ferrite core includes a plurality of convex portions arranged on an inner surface thereof in a circumferential direction of the ferrite core, the respective convex portions protrude toward a tube axis of the color picture tube apparatus, and have a ridge shape substantially along a surface including the tube axis, and among the plurality of convex portions, wherein the convex portions on a horizontal axis are horizontal axial convex portions, the convex portions on a vertical axis are vertical axial convex portions, and the convex portions in a range excluding a range of −20° to +20° with respect to the horizontal axis and a range of −20° to +20° with respect to the vertical axis are diagonal convex portions, lengths in a tube axis direction of the vertical axial convex portions are larger than those of the diagonal convex portions.

2. The color picture tube apparatus according to claim 1, wherein the lengths in the tube axis direction of the vertical axial convex portions are larger than those of the convex portions excluding the vertical axial convex portions.

3. The color picture tube apparatus according to claim 1, wherein the lengths in the tube axis direction of all the convex portions in the range of −20° to +20° with respect to the vertical axis are larger than those of the diagonal convex portions.

4. The color picture tube apparatus according to claim 1. wherein assuming that a ratio of the lengths in the tube axis direction of the convex portions with respect to a size in the tube axis direction of the ferrite core is RU, the ratio RL regarding the diagonal convex portions is 0.67 or more.

5. The color picture tube apparatus according to claim 1. wherein ends on a phosphor screen side of the convex portions whose lengths in the tube axis direction are larger than those of the diagonal convex portions are positioned further on the phosphor screen side with respect to ends on the phosphor screen side of the diagonal convex portions.

6. A color picture tube apparatus comprising a deflection yoke for allowing a horizontal deflection magnetic field and a vertical deflection magnetic field to act on electron beams emitted from an electron gun to deflect the electron beams in a horizontal direction and a vertical direction, wherein the deflection yoke includes a ferrite core, a horizontal deflection coil for generating the horizontal deflection magnetic field, a vertical deflection coil for generating the vertical deflection magnetic field, and an insulating frame for insulating the horizontal deflection coil from the vertical deflection coil, the ferrite core includes a plurality of convex portions arranged on an inner surface thereof in a circumferential direction of the ferrite core, the respective convex portions protrude toward a tube axis of the color picture tube apparatus, and have a ridge shape substantially along a surface including the tube axis, and among the plurality of convex portions, wherein the convex portions on a horizontal axis are horizontal axial convex portions, the convex portions on a vertical axis are vertical axial convex portions, and the convex portions in a range excluding a range of −20° to +20° with respect to the horizontal axis and a range of −20° to +20° with respect to the vertical axis are diagonal convex portions, lengths in a tube axis direction of the horizontal axial convex portions are larger than those of the diagonal convex portions.

7. The color picture tube apparatus according to claim 6, wherein the lengths in the tube axis direction of the horizontal axial convex portions are larger than those of the convex portions excluding the horizontal axial convex portions.

8. The color picture tube apparatus according to claim 6, wherein the lengths in the tube axis direction of all the convex portions in the range of −20° to +20° with respect tote horizontal axis are larger than those of the diagonal convex portions.

9. The color picture tube apparatus according to claim 6, wherein assuming that a ratio of the lengths in the tube axis direction of the convex portions with respect to a size in the tube axis direction of the ferrite core is RL, the ratio RL regarding the diagonal convex portions is 0.67 or more.

10. The color picture tube apparatus according to claim 6, wherein ends on a phosphor screen side of the convex portions whose lengths in the tube axis direction are larger than those of the diagonal convex portions are positioned further on the phosphor screen side with respect to ends on the phosphor screen side of the diagonal convex portions.

11. A color picture tube apparatus comprising a deflection yoke for allowing a horizontal deflection magnetic field and a vertical deflection magnetic field to act on electron beams emitted from an electron gun to deflect the electron beams in a horizontal direction and a vertical direction, wherein the deflection yoke includes a ferrite core, a horizontal deflection coil for generating the horizontal deflection magnetic field, a vertical deflection coil for generating the vertical deflection magnetic field, and an insulating frame for insulating the horizontal deflection colt horn the vertical deflection coil, the ferrite core includes a plurality of convex portions arranged on an inner surface thereof in a circumferential direction of the ferrite core, the respective convex portions protrude toward a tube axis of the color picture tube apparatus, and have a ridge shape substantially along a surface including the tube axis, and among the plurality of convex portions, wherein the convex portions on a horizontal axis are horizontal axial convex portions, the convex portions on a vertical axis arc vertical axial convex portions, and the convex portions in a range excluding a range of −20° to +20° with respect to the horizontal axis and a range of −20° to +20° with respect to the vertical axis are diagonal convex portions. lengths in a tube axis direction of the horizontal axial convex portions and the vertical axial convex portions are larger than those of the diagonal convex portions.

12. The color picture tube apparatus according to claim 11, wherein the lengths in the tube axis direction of the horizontal axial convex portions and the vertical axial convex portions are larger than those of the convex portions excluding the horizontal and vertical axial convex portions.

13. The color picture tube apparatus according to claim 11, wherein the lengths in the tube axis direction of all the convex portions in the range of −20° to +20° with respect to the horizontal axis are larger than those of the diagonal convex portions.

14. The color picture tube apparatus according to claim 11, wherein the lengths in the tube axis direction of all the convex portions in the range of −20° to +20° with respect to the vertical axis are larger than those of the diagonal convex portions.

15. The color picture tube apparatus according to claim 11, wherein assuming that a ratio of the lengths in the tube axis direction of the convex portions with respect to a size in the tube axis direction of the ferrite core is RL, the ratio RL regarding the diagonal convex portions is 0.67 or more.

16. The color picture tube apparatus according to claim 11, wherein ends on a phosphor screen side of the convex portions whose lengths in the tube axis direction are larger than those of the diagonal convex portions are positioned further on the phosphor screen side with respect to the ends on the phosphor screen side of the diagonal convex portions.

* * * * *

UNITED STATES PATENT AND TRADEMARK OFFICE

CERTIFICATE OF CORRECTION

PATENT NO. : 7,129,627 B2
APPLICATION NO. : 10/900837
DATED : October 31, 2006
INVENTOR(S) : Tagami It is certified that error appears in the above-identified patent and that said Letters Patent is hereby corrected as shown below:

Column 1, line 39: “loss-is” should read --loss is--.
Column 3, line 30: “16:9,and” should read --16:9, and--.
Column 3, line 33: “gong” should read --going--.
Column 4, line 35: “RL=1,and” should read --RL=1, and--.
Column 4, line 49: “RL=0.67.In” should read --RL=0.67. In--.
Column 4, lines 58-59: “0.67.Furthermore” should read --0.67. Furthermore--.
Column 5, line 29: “P 11” should read --P11--.
Column 6, line 62: “+20°from” should read --+20° from--.
Column 7, line 22: “.067.Furthermore” should read --.067. Furthermore--.
Column 7, lines 30-31: “0.67.However” should read --0.67. However--.
Column 7, line 31: “-is” should read --is--.
Column 8, line 5(claim 1): “rube” should read --tube--.
Column 8, line 43(claim 4): “1.” should read --1,--.
Column 8, line 46(claim 4): “RU” should read --RL--.
Column 8, line 48(claim 5): “1.” should read --1,--.
Column 9, line 23(claim 8): “tote” should read --to the--.
Column 9, line 46(claim 11): “colt horn” should read --coil from--.
Column 10, line 11(claim 11): “arc” should read --are--.
Column 10, line 15(claim 11): “portions.” should read --portions,--.

Signed and Sealed this

Twenty-sixth Day of June, 2007

JON W. DUDAS
*Director of the United States Patent and Trademark Office*